US008477908B2

(12) United States Patent
Zou et al.

(10) Patent No.: US 8,477,908 B2
(45) Date of Patent: Jul. 2, 2013

(54) SYSTEM AND METHOD FOR BEAM FOCUSING AND CONTROL IN AN INDIRECTLY HEATED CATHODE

(75) Inventors: Yun Zou, Clifton Park, NY (US); Vance Scott Robinson, Niskayuna, NY (US); Louis Paul Inzinna, Scotia, NY (US); Kenneth Roger Conway, Clifton Park, NY (US); Sergio Lemaitre, Whitefish Bay, WI (US); Mark Alan Frontera, Ballston Lake, NY (US); Xi Zhang, Ballston Lake, NY (US); Vasile Bogdan Neculaes, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 12/617,737

(22) Filed: Nov. 13, 2009

(65) Prior Publication Data

US 2011/0116593 A1 May 19, 2011

(51) Int. Cl.
*H01J 35/06* (2006.01)

(52) U.S. Cl.
USPC ..... 378/136; 378/137; 378/138

(58) Field of Classification Search
USPC ..... 378/136–138
See application file for complete search history.

(56) References Cited

U.S. PATENT DOCUMENTS

| | | | | |
|---|---|---|---|---|
| 3,885,194 | A | 5/1975 | Schumacher | |
| 4,924,136 | A | 5/1990 | Lischke et al. | |
| 5,044,005 | A | 8/1991 | De Fraguier et al. | |
| 6,333,969 | B1 * | 12/2001 | Kujirai | 378/138 |
| 6,614,147 | B2 | 9/2003 | Koizumi et al. | |
| 7,382,086 | B2 | 6/2008 | Yamagishi | |
| 2008/0187093 | A1 * | 8/2008 | Price et al. | 378/19 |

FOREIGN PATENT DOCUMENTS

DE 19800773 C1 7/1999

OTHER PUBLICATIONS

Allan Sanderson; "Four Decades of Electron Beam Development At TWI"; Paper presented at IIW Assembly Quebec, Canada, Aug. 2006, IIW Doc. IV-913-06; 17 Pages.

* cited by examiner

*Primary Examiner* — Hoon Song
(74) *Attorney, Agent, or Firm* — Maire-Claire B. Maple

(57) ABSTRACT

An indirectly heated cathode assembly is presented. The indirectly heated cathode assembly includes at least one electron source for generating a first electron beam, an emitter for producing a second electron beam when heated by the first electron beam and a focusing electrode for controlling, and directing the first electron beam towards the emitter.

22 Claims, 6 Drawing Sheets

SYSTEM AND METHOD FOR BEAM FOCUSING AND CONTROL IN AN INDIRECTLY HEATED CATHODE

BACKGROUND

Embodiments of the invention relate generally to X-ray tubes and more particularly to a method and apparatus for beam focusing and control in an indirectly heated cathode.

Typically, in computed tomography (CT) imaging systems, an X-ray source emits a fan-shaped or cone-shaped beam toward a subject or an object, such as a patient or a piece of luggage. Hereinafter, the terms "subject" and "object" may be used to include anything that is capable of being imaged. The beam, after being attenuated by the subject, impinges upon an array of radiation detectors. The intensity of the attenuated beam radiation received at the detector array is typically dependent upon the attenuation of the X-ray beam by the subject. Each detector element of a detector array produces a separate electrical signal indicative of the attenuated beam received by each detector element. The electrical signals are transmitted to a data processing system for analysis. The data processing system processes the electrical signals to facilitate generation of an image.

Generally, the X-ray source and the detector array are rotated about a gantry within an imaging plane and around the subject. Furthermore, the X-ray source generally includes an X-ray tube, which emits the X-ray beam at a focal point. Also, the X-ray detector or detector array typically includes a collimator for collimating X-ray beams received at the detector, a scintillator disposed adjacent to the collimator for converting X-rays to light energy, and photodiodes for receiving the light energy from the adjacent scintillator and producing electrical signals therefrom.

Furthermore, currently available X-ray tubes typically include a filament that generates electrons. A cathode cup surrounds the filament to focus the electrons into an electron beam. The electron beam strikes an anode causing it to emit X-rays. Unfortunately, in these configurations, the filament has a limited life and low quality of emission especially for high power applications. Further, high power applications call for the filament to be heated to a high temperature, which results in evaporation of material of the filament. This evaporation of material in turn shortens the life of the filament. Also, in a filament emitter, due to the curved surfaces of coils, the electron beam leaving the emitter has some initial transverse velocity. This initial velocity lowers the beam quality and prevents the electron beam from forming a small size focal spot on the target.

Moreover, some currently available X-ray tubes employ indirectly heated cathodes. An indirectly heated cathode generally includes an emission source heated by an electron beam that is generated from a filament disposed behind the main emitter. This configuration unfortunately results in a non-uniform distribution of temperature at the emitter. It is therefore desirable to develop a design of an X-ray tube that has a long emitter life and enhanced beam quality.

Additionally, in order to facilitate a uniform temperature at the emitter, it is desirable to develop an indirectly heated cathode that has a capability to control the beam profile striking the emitter.

BRIEF DESCRIPTION

Briefly in accordance with one aspect of the present technique, an indirectly heated cathode assembly is presented. The indirectly heated cathode assembly includes at least one electron source for generating a first electron beam, an emitter for producing a second electron beam when heated by the first electron beam and a focusing electrode for controlling and directing the first electron beam towards the emitter.

In accordance with another aspect of the present technique, an X-ray tube is presented. The X-ray tube includes a tube casing and an indirectly heated cathode assembly comprising at least one electron source for generating a first electron beam, an emitter for producing a second electron beam when heated by the first electron beam, and a focusing electrode for controlling and directing the first electron beam towards the emitter. Further, the X-ray tube includes an anode for producing X-rays when impinged upon by the second electron beam.

In accordance with a further aspect of the present technique, a computed tomography system is presented. The computed tomography system includes a gantry and an X-ray tube coupled to the gantry. The X-ray tube includes a tube casing and an indirectly heated cathode assembly including at least one electron source for generating a first electron beam, an emitter for producing a second electron beam when heated by the first electron beam, and a focusing electrode for controlling and directing the first electron beam towards the emitter. The X-ray tube also includes an anode for producing X-rays when impinged upon by the second electron beam. Further, the computed tomography system includes an X-ray controller for providing power and timing signals to the X-ray tube.

In accordance with yet another aspect of the present technique, a method of controlling an electron beam in an indirectly heated cathode assembly having at least one electron source and an emitter is presented. The method includes applying a first voltage to heat at least one electron source to generate a first electron beam, applying a potential difference between the at least one electron source and an emitter to enhance kinetic energy of the first electron beam, and directing and controlling an intensity distribution of the first electron beam towards the emitter via use of a focusing electrode. Further, the method provides for generating a second electron beam by impinging the first electron beam on the emitter.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Embodiments of the present invention relate to a beam control mechanism for an indirectly heated cathode configured for use in an X-ray tube. An X-ray tube and a computed tomography system including the exemplary indirectly heated cathode assembly, as well as a method for beam focusing and controlling the electron beam in the indirectly heated cathode assembly are presented.

Figure 1:
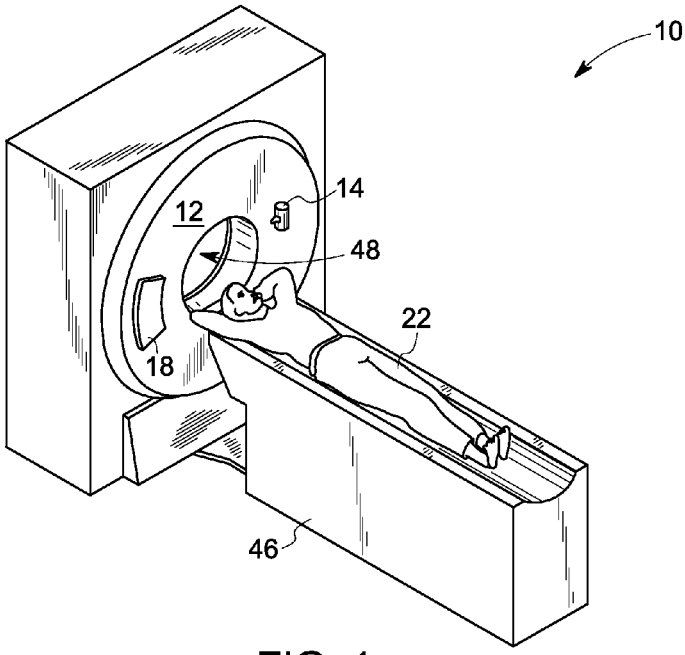
FIG. 1 is a pictorial view of a CT imaging system.
Figure 2:
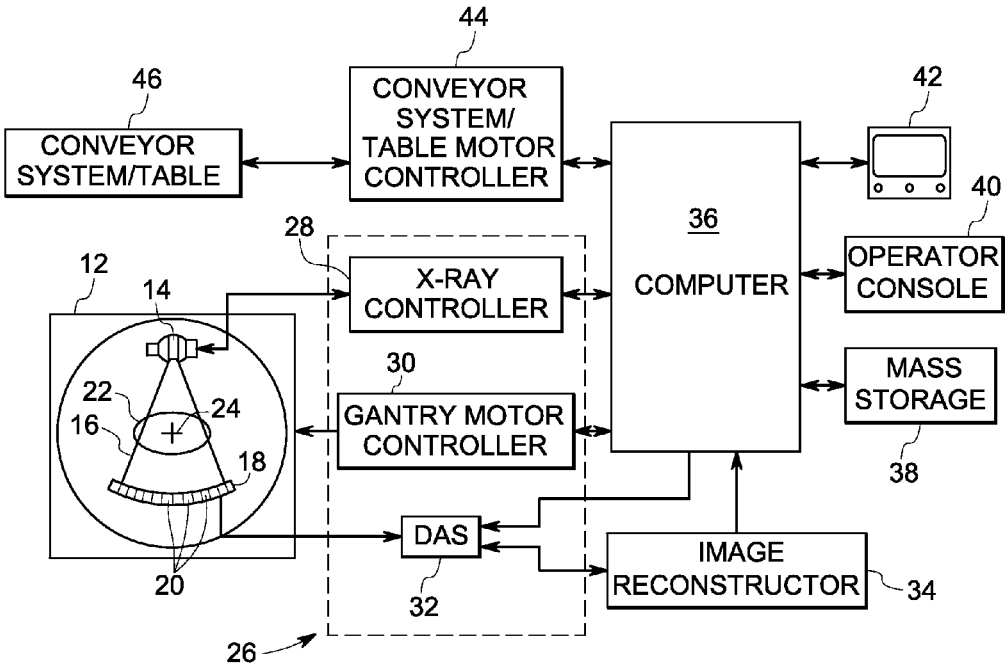
FIG. 2 is a block schematic diagram of the CT imaging system illustrated in FIG. 1.

Referring now to FIGS. 1 and 2, a computed tomography (CT) imaging system 10 is illustrated. The CT imaging system 10 includes a gantry 12. The gantry 12 has an X-ray source 14, which typically is an X-ray tube that projects a beam of X-rays 16 towards a detector array 18 positioned opposite the X-ray tube on the gantry 12. In one embodiment, the gantry 12 may have multiple X-ray sources that project beams of X-rays. The detector array 18 is formed by a plurality of detectors 20 which together sense the projected X-rays that pass through an object to be imaged, such as a patient 22. During a scan to acquire X-ray projection data, the gantry 12 and the components mounted thereon rotate about a center of rotation 24. While the CT imaging system 10 is shown in reference to a medical patient 22, it should be appreciated that the CT imaging system 10 may have applications outside the medical realm. For example, the CT imaging system 10 may be utilized for ascertaining the contents of closed articles, such as luggage, packages, etc., and in search of contraband such as explosives and/or biohazardous materials.

Rotation of the gantry 12 and the operation of the X-ray source 14 are governed by a control mechanism 26 of the CT system 10. The control mechanism 26 includes an X-ray controller 28 that provides power and timing signals to the X-ray source 14 and a gantry motor controller 30 that controls the rotational speed and position of the gantry 12. A data acquisition system (DAS) 32 in the control mechanism 26 samples analog data from the detectors 20 and converts the data to digital signals for subsequent processing. An image reconstructor 34 receives sampled and digitized X-ray data from the DAS 32 and performs high-speed reconstruction. The reconstructed image is applied as an input to a computer 36, which stores the image in a mass storage device 38.

Moreover, the computer 36 also receives commands and scanning parameters from an operator via console 40 that may have an input device such as a keyboard (not shown in FIGS. 1-2). An associated display 42 allows the operator to observe the reconstructed image and other data from the computer 36. The commands and parameters supplied by the operator are used by the computer 36 to provide control and signal information to the DAS 32, the X-ray controller 28 and the gantry motor controller 30. In addition, the computer 36 operates a table motor controller 44, which controls a motorized table 46 to position the patient 22 and the gantry 12. Particularly, the table 46 moves portions of patient 22 through a gantry opening 48. It may be noted that in certain embodiments, the computer 36 may operate a conveyor system controller 44, which controls a conveyor system 46 to position an object, such as, baggage or luggage and the gantry 12. More particularly, the conveyor system 46 moves the object through the gantry opening 48.

As previously noted, the X-ray source is typically an X-ray tube that includes at least a cathode and an anode. The cathode may be a directly heated cathode or an indirectly heated cathode. Typically, in currently available indirectly heated cathodes, the cathode is heated by thermal conduction from a directly heated coil filament or an auxiliary filament. In addition, indirectly heated cathodes may also be heated by vacuum electron beam that is generated by an auxiliary emitter, such as a filament. Unfortunately, beam currents generated by such indirectly heated cathodes are generally lower than desired because of high resistance of the coil filament. Additionally, the currently available indirectly heated cathodes fail to control the intensity distribution of the electron beam impinging upon an emitter, thereby resulting in an undesirable intensity distribution of the electron beam. Accordingly, an exemplary X-ray tube is presented, where the X-ray tube includes an exemplary indirectly heated cathode assembly configured to circumvent the shortcomings of the currently available indirectly heated cathode assemblies.

Figure 3:
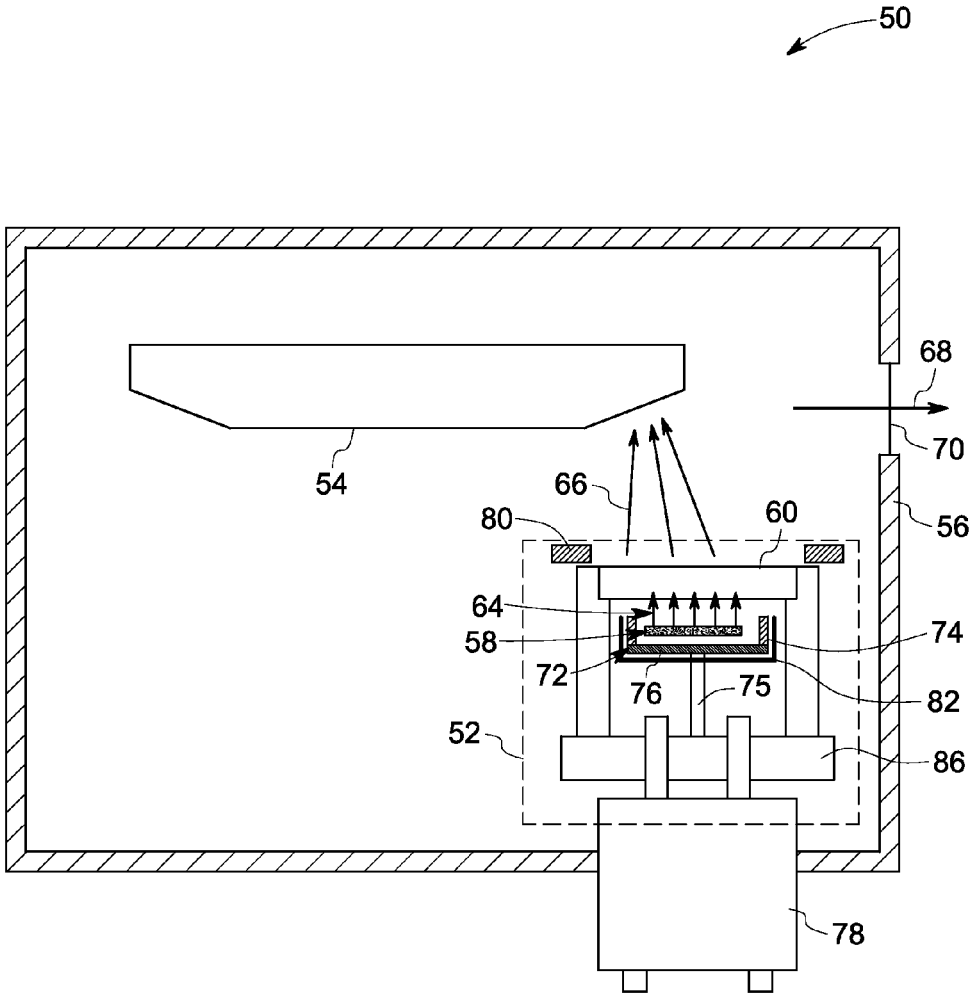
FIG. 3 is a diagrammatical illustration of an exemplary X-ray tube, in accordance with aspects of the present technique.

FIG. 3 is a diagrammatical illustration of an exemplary X-ray tube 50, in accordance with aspects of the present technique. In one embodiment, the X-ray tube 50 may be the X-ray source 14 (see FIGS. 1-2). In the illustrated embodiment, the X-ray tube 50 includes an exemplary indirectly heated cathode assembly 52 disposed within a tube casing 56. In addition, the X-ray tube 50 also includes an anode 54 disposed within the tube casing 56. In accordance with aspects of the present technique, the indirectly heated cathode assembly 52 includes at least one electron source 58. In accordance with aspects of the present technique, the at least one electron source 58 may include a cold field emitter, a thermionic electron source, or a combination thereof. It may be noted that the electron source 58 may include a single electron source, a dual electron source, a multi-electron source, or combinations thereof. In one embodiment, the electron source 58 may include at least one coil filament. The coil filament may include a single coil filament, a dual coil filament, a multi-coil filament, or combinations thereof.

It may be noted that if the electron source 58 is a thermionic electron source, the electron source 58 may be configured to generate electrons in response to a flow of electron current through the electron source 58. The flow of electron current increases the temperature of the electron source 58 due to Joule heating.

In accordance with aspects of the present technique, the thermionic electron source, such as the electron source 58, may be formed from a material that has a high melting point and is capable of stable electron emission at high temperatures. Also, the electron source 58 may be formed from materials capable of generating electrons upon heating, such as, but not limited to, tungsten, thoriated tungsten, tungsten rhenium, molybdenum, and the like. Furthermore, the electron source 58 may be formed from an alkaline earth metal or an oxide of the alkaline earth metal, such as, but not limited to, barium oxide, calcium oxide, strontium oxide, and the like.

Moreover, in an embodiment, where the electron source 58 is a thermionic electron source, the electron source 58 may be heated by applying a voltage to the at least one electron source 58 via a filament lead (not shown in FIG. 3). In certain embodiments, a first voltage source (not shown in FIG. 3) may be used to apply the voltage to the ends of the electron source 58. The electrons generated by the electron source 58 may generally be referred to as a first electron beam 64. As used herein, the term "electron beam" may be used to refer to a stream of electrons that have substantially similar velocities.

The first electron beam 64 that includes the stream of electrons generated by the electron source 58 may impinge on an emitter 60. In accordance with exemplary aspects of the present technique, a high voltage differential may be applied between the electron source 58 and the emitter 60 to accelerate the electrons in the first electron beam 64 towards the emitter 60. In certain embodiments, a second voltage source (not shown in FIG. 3) may be employed to apply the high voltage differential between the electron source 58 and the emitter 60. In an alternative embodiment, the high voltage differential between the electron source 58 and the emitter 60 may be applied via use of the first voltage source. For example, the first voltage source may include a plurality of voltage tabs for facilitating supply of a plurality of desired voltages.

As noted hereinabove, the high voltage differential applied between the electron source 58 and the emitter 60 results in acceleration of electrons in the first electron beam 64 towards the emitter 60. More particularly, the high voltage differential applied between the electron source 58 and the emitter 60 increases the kinetic energy of the electrons in the first electron beam 64. This kinetic energy is converted into thermal energy when the electrons strike the emitter 60, thereby resulting in an increase in temperature of the emitter 60. By way of example, in certain embodiments, the emitter 60 may be heated to about 2500 degrees centigrade by the impinging first electron beam 64. The heated emitter 60 in turn starts emitting electrons that may generally be referred to as a second electron beam 66. More particularly, the emitter 60, when impinged upon by the first electron beam 64, may generate the second electron beam 66. The second electron beam 66 impinges upon the target 54 (also referred to as the anode) to produce X-rays 68.

Furthermore, when the second electron beam 66 impinges upon the target 54, a large amount of heat is generated in the target 54. Unfortunately, the heat generated in the target 54 may be significant enough to melt the target 54. In accordance with aspects of the present technique, a rotating target may be used to circumvent the problem of heat generation in the target 54. More particularly, in one embodiment, the target 54 may be configured to rotate such that the second electron beam 66 striking the target 54 does not cause the target 54 to melt since the second electron beam 66 does not strike the target 54 at the same location. In another embodiment, the target 54 may include a stationary target. The target 54 may be made of a material that is capable of withstanding the heat generated by the impact of the second electron beam 66. For example, the target 54 may include materials such as, but not limited to, tungsten, molybdenum, or copper.

In accordance with aspects of the present technique, the second electron beam 66 may be accelerated from the emitter 60 towards the target 54. More particularly, the second electron beam 66 may be accelerated from the emitter 60 towards the target 54 by applying a potential difference between the emitter 60 and the target 54. In one embodiment, a high voltage in the range from about 40 kV to about 450 kV may be applied via use of a high voltage feedthrough 78 to set up a potential difference between the emitter 60 and the target 54. In one embodiment, a high voltage of about 140 kV may be applied between the emitter 60 and the target 54 to accelerate the electrons in the second electron beam 66 towards the target 54. Additionally, a focusing cup 80 may be employed to focus the second electron beam 66 as the second electron beam 66 is accelerated towards the target 54. As illustrated in FIG. 3, the focusing cup 80 may be disposed adjacent to the emitter 60. The X-rays 68 generated by the target 54 may be directed from the X-ray tube 50 through an opening, which may be generally referred to as an X-ray window 70, towards an object (not shown in FIG. 3).

With continuing reference to FIG. 3, in accordance with an exemplary aspect of the present technique, the indirectly heated cathode assembly 52 may also include a focusing electrode 72. The focusing electrode 72 may be configured to control the first electron beam 64 that impinges on the emitter 60. More particularly, the focusing electrode 72 may be configured to control an intensity distribution of the first electron beam 64 that impinges on the emitter 60. Also, in one embodiment, the focusing electrode 72 may surround the electron source 58.

In accordance with aspects of the present technique, the focusing electrode 72 may also shield heat generated by the electron source 58. Furthermore, in a presently contemplated configuration, the focusing electrode 72 includes a side wall 74 and a horizontal wall 76. In one embodiment, the side wall 74 may be cylindrical in shape. The side wall 74 may also be configured to act as a radiation shield thereby decreasing radiation loss to the surroundings. In one embodiment, the horizontal wall 76 may be configured to provide support to the side wall 74. The dimensions of the side wall 74 and the horizontal wall 76 may be varied to control and focus the first electron beam 64 striking the emitter 60. Moreover, the horizontal wall 76 may also be employed as a thermal shield.

In accordance with aspects of the present technique, a high temperature refractory metal may be used to form the focusing electrode 72. For example, the focusing electrode 72 may include materials such as, but not limited to, molybdenum, tungsten or tantalum. Furthermore, in one embodiment, the focusing electrode 72 may be formed as a single piece structure. Alternatively, the focusing electrode 72 may be formed by brazing the side wall 74 with the horizontal wall 76. In an alternative embodiment, the side wall 74 may be welded to the horizontal wall 76 to form the focusing electrode 72.

Additionally, in accordance with an exemplary aspect of the present technique, the focusing electrode 72 may be maintained at a voltage potential lower than a voltage potential of the electron source 58. Accordingly, a voltage may be applied between the focusing electrode 72 and the electron source 58 such that the focusing electrode 72 is maintained at a voltage potential that is lower than the voltage potential of the electron source 58. The lower voltage potential of the focusing electrode 72 prevents the electrons generated by the electron source 58 from moving towards the focusing electrode 72 and thereby focusing the electrons towards the emitter 60. In accordance with aspects of the present technique, a vertical support 75 coupled to an insulator base 86, may be employed to support the focusing electrode 72. Since the distance between the electron source 58 and the focusing electrode 72 may influence the focusing of electrons towards the emitter 60. Accordingly, the length of the vertical support 75 may be altered to change the distance between the electron source 58 and the focusing electrode 72 to enhance the focusing of the first electron beam 64.

Furthermore, in accordance with aspects of the present technique, the indirectly heated cathode assembly 52 may include a heat shield 82. As illustrated in FIG. 3, the heat shield 82 surrounds the focusing electrode 72. More particularly, in one embodiment, the heat shield 82 may be placed at a radial distance of about 0.5 mm from the focusing electrode 72. In the presently contemplated configuration, the heat shield 82 is coupled to the vertical support 75. The heat shield 82 is configured to shield the surrounding parts in the indirectly heated cathode assembly 52 from the heat generated by the electron source 58. In accordance with aspects of the present technique, a high temperature refractory metal may be used to form the heat shield 82. In a non-limiting example, the heat shield 82 may be formed using molybdenum. Also, in one configuration, the horizontal wall 76 may be absent from the focusing electrode 72. In such a configuration, the side wall 74 in the focusing electrode 72 may be supported by the heat shield 82.

Figure 4:
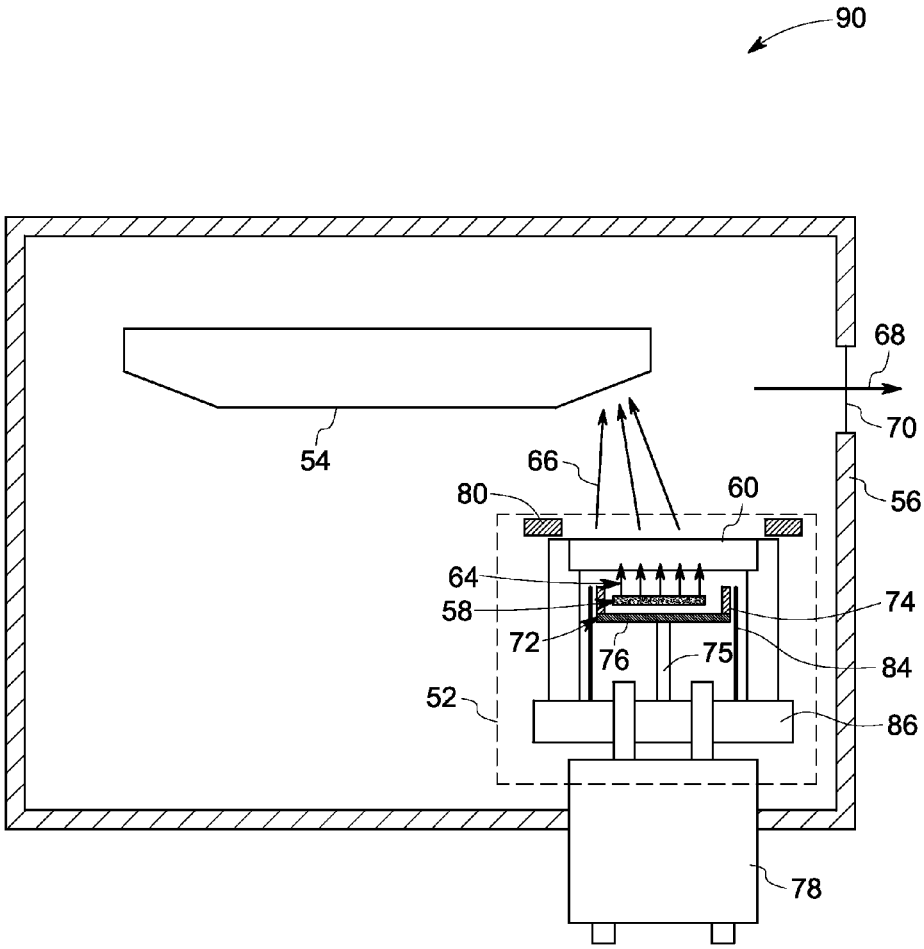
FIG. 4 is a diagrammatical illustration of another exemplary X-ray tube, in accordance with aspects of the present technique.

FIG. 4 is a diagrammatical illustration of another exemplary X-ray tube 90, in accordance with aspects of the present technique. In the embodiment of FIG. 4, a heat shield 84 is disposed adjacent to the focusing electrode 72. In the present embodiment, the heat shield 84 is coupled to the insulator base 86. Furthermore, it may be noted that the heat shield 84 may be maintained at a voltage potential that is substantially similar to a voltage potential of the focusing electrode 72. In an alternative embodiment, the heat shield 84 may be maintained at a voltage potential that is substantially similar to a voltage potential of the emitter 60.

Figure 5:
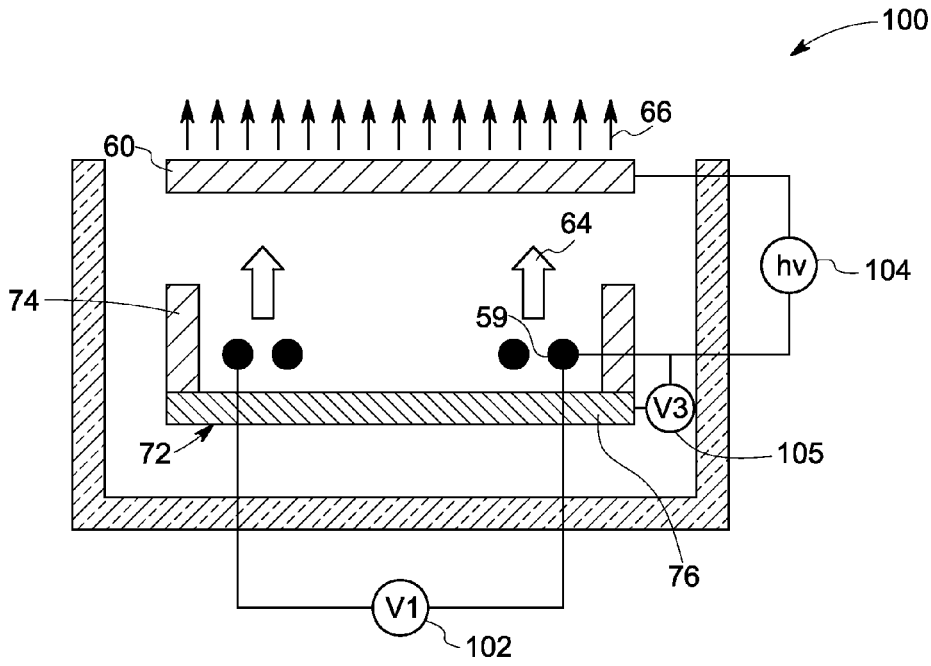
FIG. 5 is a cross-sectional view of an exemplary indirectly heated cathode assembly for use in the X-ray tube of FIG. 3, in accordance with aspects of the present technique.

Turning now to FIG. 5, in accordance with aspects of the present technique, a cross-sectional view of one embodiment of an indirectly heated cathode assembly 100 for use in the X-ray tube 50 of FIG. 3 and the X-ray tube 90 of FIG. 4 is presented. As previously noted, the indirectly heated cathode assembly 100 includes at least one electron source. In the embodiment depicted in FIG. 5, the electron source includes at least one coil filament 59. The coil filament 59 may be a single coil filament, a dual coil filament, or a multi-coil filament, as previously noted. In accordance with aspects of the present technique, the coil filaments 59 may be formed from a material that generates electrons upon being heated via Joule heating. By way of example, the coil filaments 59 may be formed from a material, such as, but not limited to, tungsten, thoriated tungsten, tungsten rhenium, or molybdenum. In accordance with aspects of the present technique, a first voltage source 102 may be used to apply a voltage across the ends of the coil filaments 59 to generate electrons that form the first electron beam 64.

In another embodiment, a planar coil filament may be employed in the exemplary indirectly heated cathode assembly 100. In accordance with aspects of the present technique, the coil filaments 59 may be resistively heated to a high temperature of about 2400 degrees centigrade. The first voltage source 102, for example, may be employed to heat the coil filaments 59. It may be noted that the first voltage source 102 may include a direct current (DC) voltage supply or an alternating current (AC) voltage supply. As previously noted, the indirectly heated cathode assembly 100 includes the emitter 60 which when impinged upon by the first electron beam 64, emits the second electron beam 66. The electrons generated from the coil filaments 59, namely the first electron beam 64 may be focused or directed towards the emitter 60 via use of the exemplary focusing electrode 72. More particularly, a second voltage source 104 may be employed to apply a potential difference between the coil filaments 59 and the emitter 60 to accelerate the stream of electrons in the first electron beam 64 towards the emitter 60.

In accordance with aspects of the present technique, the potential difference between the coil filaments 59 and the emitter 60 supplied by the second voltage source 104 may be controlled to circumvent thermal run away in the emitter 60. Thermal run away in the emitter 60 may be caused when heat from the emitter 60 flows back to the coil filaments 59 resulting in a positive feedback. The thermal run away may be avoided by operating the electron source, such as the coil filaments 59 in a space charge limited regime instead of a temperature limited regime. The space charge limited regime is formed when emission of electrons from the electron source is limited by an electric field formed on a surface of the electron source rather than the temperature of the electron source, such as the coil filaments 59.

With continuing reference to FIG. 5, the focusing electrode 72 includes the side wall 74 and the horizontal wall 76, as previously noted. In one embodiment, the horizontal wall 76 supports the side wall 74. As previously noted, the focusing electrode 72 may be configured to control and focus the first electron beam 64 towards the emitter 60. More particularly, in accordance with exemplary aspects of the present technique, focusing of the first electron beam 64 may be achieved by varying the dimensions of the side wall 74 and the horizontal wall 76 with respect to the coil filaments 59.

Moreover, a third voltage source 105 may be employed to apply a potential difference between the coil filaments 59 and the focusing electrode 72 to prevent the electrons generated by the coil filaments 59 from moving towards the focusing electrode 72 and thereby focusing the electrons towards the emitter 60. In another embodiment, the voltage potential supplied by the first voltage source 102, and the potential differences supplied by the second voltage source 104 and the third voltage source 105 may be achieved via a single voltage source. The single voltage source may include a plurality of voltage tabs for facilitating supply of a plurality of desired voltage potentials and potential differences, such as those supplied by the first voltage source 102, the second voltage source 104, and the third voltage source 105.

Figure 6:
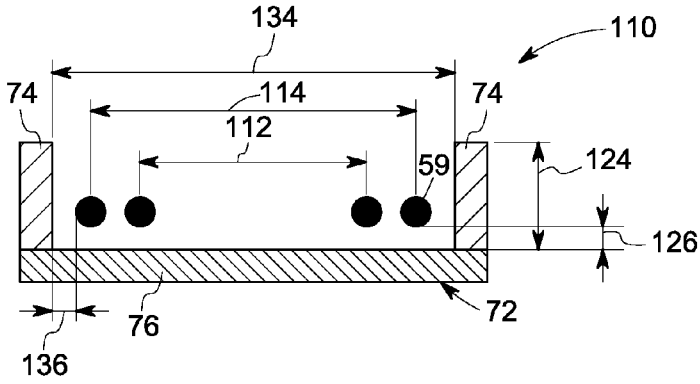
FIG. 6 is a detailed view of a focusing electrode for use in the exemplary indirectly heated cathode assembly of FIG. 5, in accordance with aspects of the present technique.

Referring now to FIG. 6, a detailed view 110 of the focusing electrode 72 of FIG. 5, depicting a relationship between the dimensions of side wall 74, the horizontal wall 76, and the coil filaments 59 is presented. The coil filaments 59 are depicted as being surrounded by the side wall 74 and the horizontal wall 76. As previously noted with respect to FIG. 5, in accordance with aspects of the present technique, the dimensions of the focusing electrode 72 may be varied to control the intensity distribution of an electron beam, such as the first electron beam 64. Some of the dimensions that may be varied include a height 124 of the side wall, a distance 134 between the side walls 74, a distance 126 between the coil filaments 59 and the horizontal wall 76, a distance 136 between the coil filaments 59 and the side wall 74, a separation 112 between an inner diameter of coil filaments 59 and a separation 114 between an outer diameter of the coil filaments 59. According to aspects of the present technique, some or all of these dimensions may be altered to control the intensity distribution of the electrons emitted from the coil filaments 59 and configured to impinge upon an emitter, such as the emitter 60 (see FIG. 5).

In one example, the height 124 of the side wall 74 may range from about 0.5 mm to about 10 mm and the distance 134 between the side walls 74 may be varied in accordance with the coil filament size. In another example, the distance 136 between the side wall 74 and the coil filament 59 may be varied in a range from about 0.1 mm to about 5 mm. In yet another example, the distance 126 between the coil filament 59 and the horizontal wall 76 may be varied from about 0.1 mm to about 20 mm. Similarly, the separation 112 between the inner diameters of the coil filaments 59 may be varied in a range from about 1 mm to about 20 mm and the separation 114 between the outer diameters of the coil filaments 59 may be varied in a range from about 1 mm to about 50 mm, or as per requirement.

Furthermore, the focusing of the electrons in the first electron beam 64 striking the emitter 60 may be increased by increasing the height 124 of the side wall 74. Alternatively, decreasing the height of side wall 74 may result in a decrease in the focusing of electrons striking the emitter 60. In another example, focusing of the first electron beam 64 may also be altered by altering the distance 136 between the coil filament 59 and the side wall 74. More particularly, the smaller the distance 136 between the coil filaments 59 and the side wall 74, the stronger the focusing of electrons striking the emitter 60. Similarly, on increasing the distance 136 between the coil filaments 59 and the side wall 74, the focusing of electrons striking the emitter will be diminished. Also, increasing the distance 126 between the coil filaments 59 and the horizontal wall 76 decreases the focusing of electrons striking the emitter 60.

Figure 7:
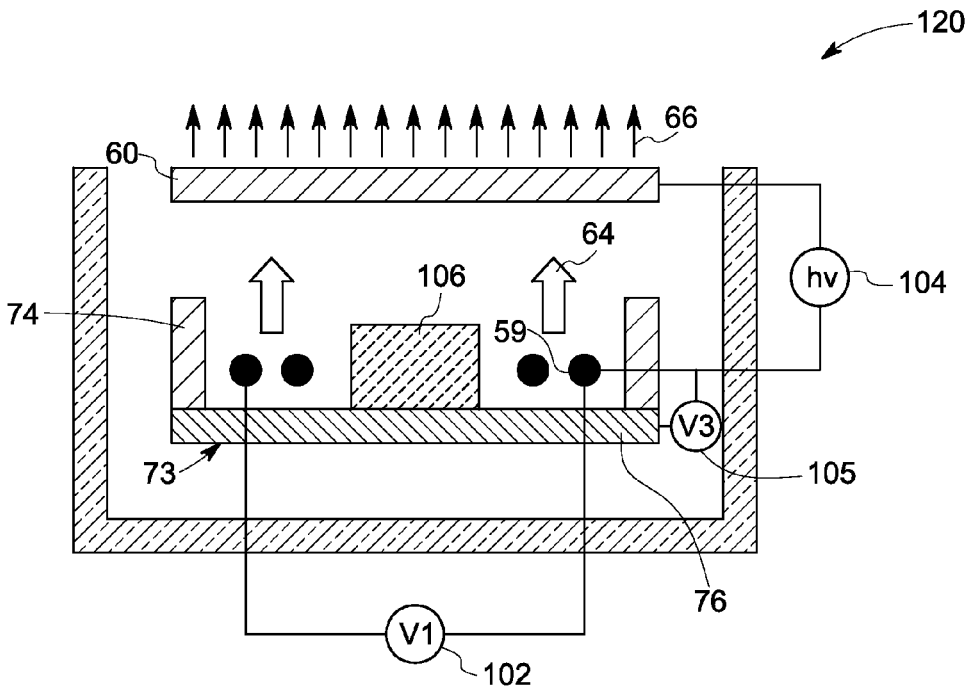
FIG. 7 is a cross-sectional view of another exemplary indirectly heated cathode assembly, in accordance with aspects of the present technique.

Referring now to FIG. 7, a cross-sectional view of another embodiment of an indirectly heated cathode assembly 120 is presented. As previously noted, the indirectly heated cathode assembly 120 includes at least one coil filament 59 configured to emit electrons to form the first electron beam 64. The indirectly heated cathode assembly 120 includes the emitter 60 which when impinged upon by the first electron beam 64 emits the second electron beam 66. In accordance with aspects of the present technique, the electrons generated by the coil filaments 59 may be focused or directed towards the emitter 60 via use of an exemplary focusing electrode 73. In the embodiment illustrated in FIG. 7, the focusing electrode 73 may further include a central wall 106 in addition to the side wall 74 and the horizontal wall 76. In one embodiment, the central wall 106 is surrounded by the coil filaments 59. The central wall 106 may be formed from a high temperature refractory metal such as molybdenum, tungsten or tantalum. Furthermore, in one embodiment, the focusing electrode 73 including central wall 106 may be formed as a single piece structure. Alternatively, the focusing electrode 73 may be formed by brazing the side wall 74 and the central wall 106 with the horizontal wall 76. In an alternative embodiment, the side wall 74 and the central wall 106 may be welded to the horizontal wall 76 to form the focusing electrode 73.

Figure 8:
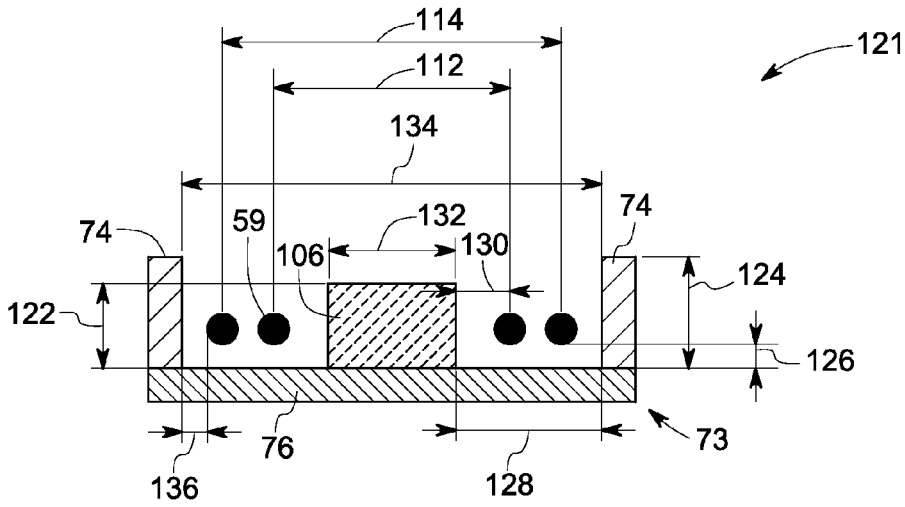
FIG. 8 is a detailed view of a focusing electrode for use in the exemplary indirectly heated cathode assembly of FIG. 7, in accordance with aspects of the present technique.

Referring now to FIG. 8, a detailed view 121 of the focusing electrode 73 of FIG. 7, depicting a relationship between the dimensions of side wall 74, the central wall 106, the horizontal wall 76 and the coil filaments 59 is presented. As previously noted, in accordance with aspects of the present technique, the dimensions of the focusing electrode 73 may be varied to control the intensity distribution of an electron beam, such as the first electron beam 64. With specific reference to the central wall 106, some of the dimensions that may be varied include a height 122 of the central wall 106, a width 132 of the central wall 106, a distance 130 between the central wall 106 and the coil filaments 59, and a distance 128 between the side wall 74 and the central wall 106.

In one example, the width 132 of the central wall 106 may be varied in a range from about 0.5 mm to about 10 mm, or as per requirement. In another example, the height 122 of the central wall 106 may be varied in a range from about 0 mm to about 10 mm. In yet another example, the distance 130 between the central wall 106 and the coil filaments 59 may be varied in a range from about 0.1 to about 10 mm.

Figure 9:
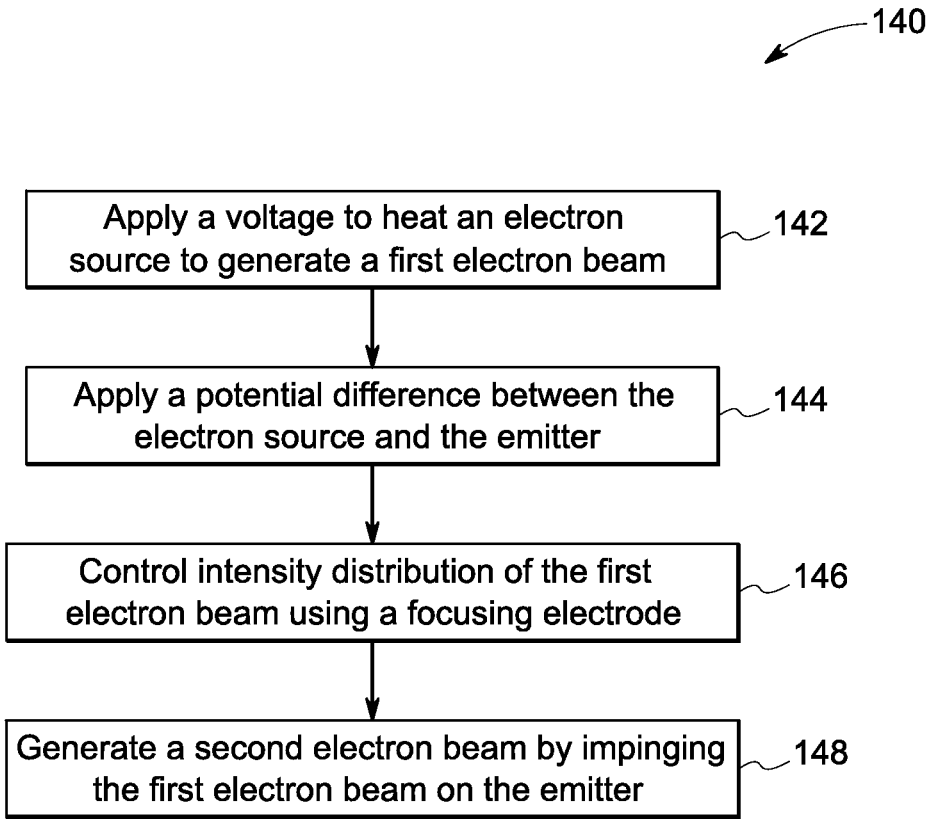
FIG. 9 is a flowchart illustrating a method for beam focusing and controlling the electron beam in the indirectly heated cathodes of FIGS. 5 and 7, in accordance with aspects of the present technique.

FIG. 9 is a flowchart illustrating a method 140 for controlling an electron beam in an indirectly heated cathode in accordance with aspects of the present technique. More particularly, the method is drawn to focusing and controlling the electron beam emitted by at least one electron source, such as the electron source 58 (see FIG. 3) towards an emitter, such as the emitter 60 (see FIG. 5 and FIG. 7). The method starts at step 142 where a voltage may be applied across the electron source 58 to generate a first electron beam, such as the first electron beam 64 (see FIG. 3). By way of example, a voltage source, such as the first voltage source 102 (see FIG. 5) may be used to apply the voltage to the electron source 58 to generate the first electron beam 64.

Subsequently, a potential difference may be applied between the electron source and the emitter to accelerate the electrons in the first electron beam towards the emitter, as indicated by step 144. For example, a second voltage source, such as, the second voltage source 104 (see FIG. 5), may be used to apply the potential difference between the electron source and the emitter to increase the kinetic energy of the first electron beam.

Additionally, the intensity distribution of the first electron beam may be controlled by directing the first electron beam towards the emitter via use of a focusing electrode, as depicted in step 146. More particularly, the first electron beam may be directed towards the emitter via use of a focusing electrode. As previously noted, a focusing electrode, such as the focusing electrode 72 (see FIG. 5) that includes a side wall and a horizontal wall may be employed. In an alternative embodiment, a focusing electrode, such as the focusing electrode 73 (see FIG. 7) that includes a side wall, a central wall and a horizontal wall may be employed. The dimensions of the side wall, the central wall and the horizontal wall may be altered to control and focus the first electron beam from the electron source, such as the coil filaments towards the emitter. Furthermore, at step 148, a second electron beam may be generated by impinging the first electron beam on the emitter. The high kinetic energy of electrons in the first electron beam results in the electrons in the first electron beam impinging upon the emitter with high energy, thereby increasing the temperature of the emitter. For example, in certain embodiments, the emitter may be heated to about 2500 degrees centigrade. The heated emitter may be configured to emit electrons generally representative of a second electron beam. The second electron beam may be configured to impinge on an anode to produce X-rays.

The various embodiments of the indirectly heated cathode for use in an X-ray tube as described hereinabove have several advantages including durability and an enhanced quality of electron beam. Also, the exemplary indirectly heated cathode is capable of controlling the electron beam intensity. Moreover, the beam energy delivered onto the emitter can be controlled via use of the exemplary indirectly heated cathode. Additionally, the design of the exemplary indirectly heated cathode also ensures that entire electron beam energy is efficiently utilized to heat the emitter without heating the surrounding cathode assembly and also helps in achieving a desirable temperature distribution on the emitter surface from which the second electron beam is generated. Furthermore, the design of the exemplary indirectly heated cathode allows use of a curved emitter. The curved emitter may further help in constructing an X-ray tube with large emission current and a smaller focal spot size.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An indirectly heated cathode assembly, comprising:

at least one electron source comprising a single cylindrical coil filament for generating a first electron beam;

an emitter for producing a second electron beam when heated by the first electron beam; and a focusing electrode comprising at least one side wall, a horizontal wall, and a central wall coupled to the horizontal wall, wherein the single cylindrical coil filament surrounds the central wall, and wherein the side wall, the central wall and the horizontal wall are selectively positioned with resect to the single cylindrical coil filament so as to control an intensity distribution of the first electron beam impinging upon the emitter.

2. The indirectly heated cathode assembly of claim 1, wherein the at least one electron source comprises a single electron source or multiple electron sources.

3. The indirectly heated cathode assembly of claim 1, wherein the at least one electron source comprises a thermionic electron source or a cold field emitter.

4. The indirectly heated cathode assembly of claim 1, wherein the at least one electron source comprises tungsten, thoriated tungsten, tungsten rhenium, molybdenum, or combinations thereof.

5. The indirectly heated cathode assembly of claim 1, wherein the at least one electron source comprises an alkaline earth metal or an oxide thereof.

6. The indirectly heated cathode assembly of claim 1, wherein the at least one electron source is at a voltage potential different from a voltage potential of the emitter.

7. The indirectly heated cathode assembly of claim 1, wherein the focusing electrode surrounds the at least one electron source.

8. The indirectly heated cathode assembly of claim 1, wherein the focusing electrode shields heat generated by the at least one electron source.

9. The indirectly heated cathode assembly of claim 1, where the focusing electrode is at a voltage potential different from a voltage potential of the at least one electron source.

10. The indirectly heated cathode assembly of claim 1, further comprising a heat shield, wherein the heat shield surrounds the focusing electrode.

11. An X-ray tube, comprising:

a tube casing;

an indirectly heated cathode assembly, comprising:

at least one electron source comprising a single cylindrical coil filament for generating a first electron beam;

an emitter for producing a second electron beam when heated by the first electron beam;

a focusing electrode comprising at least one side wall, a horizontal wall, and a central wall coupled to the horizontal wall, wherein the single cylindrical coil filament surrounds the central wall, and wherein the side wall, the central wall and the horizontal wall are selectively positioned with respect to the single cylindrical coil filament so as to control an intensity distribution of the first electron beam impinging upon the emitter; and an anode for producing X-rays when impinged upon by the second electron beam.

12. The X-ray tube of claim 11, wherein the tube casing encloses the indirectly heated cathode assembly and the anode.

13. The X-ray tube of claim 11, wherein the focusing electrode comprises a side wall and a horizontal wall.

14. The X-ray tube of claim 13, wherein the focusing electrode further comprises a central wall coupled to the horizontal wall.

15. The X-ray tube of claim 13, wherein the side wall, the central wall and the horizontal wall are positioned to control an intensity distribution of the first electron beam impinging upon the emitter.

16. A computed tomography system, comprising:

a gantry;

an X-ray tube coupled to the gantry, comprising:

a tube casing;

an indirectly heated cathode assembly, comprising:

at least one electron source comprising a single cylindrical coil filament for generating a first electron beam;

an emitter for producing a second electron beam when heated by the first electron beam;

a focusing electrode comprising at least one side wall, a horizontal wall, and a central wall coupled to the horizontal wall, wherein the single cylindrical coil filament surrounds the central wall, and wherein the side wall, the central wall and the horizontal wall are selectively positioned with resect to the single cylindrical coil filament so as to control an intensity distribution of the first electron beam impinging upon the emitter;

an anode for producing X-rays when impinged upon by the second electron beam; and an X-ray controller for providing power and timing signals to the X-ray tube.

17. In an indirectly heated cathode assembly having at least one electron source and an emitter, a method of controlling an electron beam, comprising:

applying a first voltage to heat the at least one electron source comprising a single cylindrical coil filament to generate a first electron beam;

applying a potential difference between the at least one electron source and the emitter to enhance kinetic energy of the first electron beam;

directing and controlling an intensity distribution of the first electron beam towards the emitter using a focusing electrode comprising at least one side wall, a horizontal wall, and a central wall coupled to the horizontal wall, wherein the single cylindrical coil filament surrounds the central wall, and wherein the side wall, the central wall and the horizontal wall are selectively positioned with respect to the single cylindrical coil filament so as to control an intensity distribution of the first electron beam impinging upon the emitter; and generating a second electron beam by impinging the first electron beam on the emitter.

18. The method of claim 17, comprising varying one or more dimensions of the side wall, the horizontal wall, the central wall, or combinations thereof, with respect to the electron source so as to control an intensity distribution of the first electron beam impinging upon the emitter.

19. The method of claim 18, wherein varying the one or more dimensions comprises varying a height of the side wall, a width of the side wall, a distance between two side walls, a distance between the electron source and the horizontal wall, a distance between the electron source and the side wall, a separation between an inner diameter of coil filaments in the electron source, a separation between an outer diameter of the coil filaments in the electron source, a length of the horizontal wall, a width of the horizontal wall, a height of the central wall, a width of the central wall, a distance between the central wall and the electron source, and a distance between the side wall and the central wall, or combinations thereof.

20. The indirectly heated cathode assembly of claim 1, where the focusing electrode is at a voltage potential substantially similar to a voltage potential of the electron source.

21. The indirectly heated cathode assembly of claim 1, wherein one or more dimensions of the side wall, the horizontal wall, the central wall, or combinations thereof, are varied with respect to the electron source so as to control an intensity distribution of the first electron beam impinging upon the emitter.

22. The indirectly heated cathode assembly of claim 21, wherein the one or more dimensions comprise a height of the side wall, a width of the side wall, a distance between two side walls, a distance between the electron source and the horizontal wall, a distance between the electron source and the side wall, a separation between an inner diameter of coil filaments in the electron source, a separation between an outer diameter of the coil filaments in the electron source, a length of the horizontal wall, a width of the horizontal wall, a height of the central wall, a width of the central wall, a distance between the central wall and the electron source, and a distance between the side wall and the central wall, or combinations thereof.

* * * * *